US007107807B2

(12) United States Patent
Ingvarsson et al.

(10) Patent No.: US 7,107,807 B2
(45) Date of Patent: Sep. 19, 2006

(54) ROLL FORMING MACHINE

(75) Inventors: Lars Ingvarsson, Borlange (SE); Lars Rudman, Stockholm (SE)

(73) Assignee: Ortic AB, Borlange (SE)

( * ) Notice: Subject to any disclaimer, the term of this patent is extended or adjusted under 35 U.S.C. 154(b) by 0 days.

(21) Appl. No.: 10/432,473

(22) PCT Filed: Nov. 26, 2001

(86) PCT No.: PCT/SE01/02601

§ 371 (c)(1),
(2), (4) Date: Jul. 24, 2003

(87) PCT Pub. No.: WO02/43886

PCT Pub. Date: Jun. 6, 2002

(65) Prior Publication Data

US 2004/0040357 A1 Mar. 4, 2004

(30) Foreign Application Priority Data

Nov. 29, 2000 (SE) ..... 0004409
Sep. 27, 2001 (SE) ..... 0103228

(51) Int. Cl.
*B21D 5/08* (2006.01)

(52) U.S. Cl. ..... 72/181; 72/129

(58) Field of Classification Search ..... 72/181, 72/179, 52, 226
See application file for complete search history.

(56) References Cited

U.S. PATENT DOCUMENTS

| | | | | |
|---|---|---|---|---|
| 3,051,214 A | | 8/1962 | Rutten | |
| 3,765,211 A | * | 10/1973 | Struss | 72/214 |
| 3,931,725 A | | 1/1976 | Yon | |
| 4,287,742 A | * | 9/1981 | Heiman | 72/49 |
| 4,660,399 A | * | 4/1987 | Suter et al. | 72/181 |
| 4,918,797 A | | 4/1990 | Watkins et al. | |
| 4,947,671 A | * | 8/1990 | Lindstrom | 72/181 |
| 5,088,309 A | * | 2/1992 | Knudson | 72/129 |
| 5,142,894 A | * | 9/1992 | Gutowski | 72/129 |
| 5,315,853 A | | 5/1994 | Scheiterle | |
| 5,722,278 A | * | 3/1998 | Horino et al. | 72/8.3 |
| 5,732,582 A | | 3/1998 | Knudson | |
| 6,115,899 A | | 9/2000 | Rider | |

FOREIGN PATENT DOCUMENTS

| | | |
|---|---|---|
| AU | 199859441 | 10/1998 |
| EP | 0350882 | 1/1990 |
| JP | 56056729 | 5/1981 |
| JP | 9052125 | 2/1997 |
| JP | 9122762 | 5/1997 |
| WO | 8701977 | 4/1987 |

* cited by examiner

*Primary Examiner*—Daniel C. Crane
(74) *Attorney, Agent, or Firm*—Mark P. Stone

(57) ABSTRACT

A roll-forming machine includes in line a device (11) for unwinding metal strip (10) from a strip reel (12), a strip cutter (18), and a roll-forming section (30; 90). The roll-forming section includes a row of forming stations that include forming rolls that are carried by shafts which are supported on a respective one side of the sheet section. Each row of forming stations includes an edge cutter (58, 59; 102, 103) and a first forming station mounted on a common movable carrier (31, 32; 100, 101), for collective movement. The angle of the carrier relative to the longitudinal axis of the forming section can be adjusted and the carrier can be moved in a parallel manner transversely to said longitudinal axis so as to enable said movement and said angular adjustment of these forming stations to be achieved simultaneously.

18 Claims, 10 Drawing Sheets

FIG 3
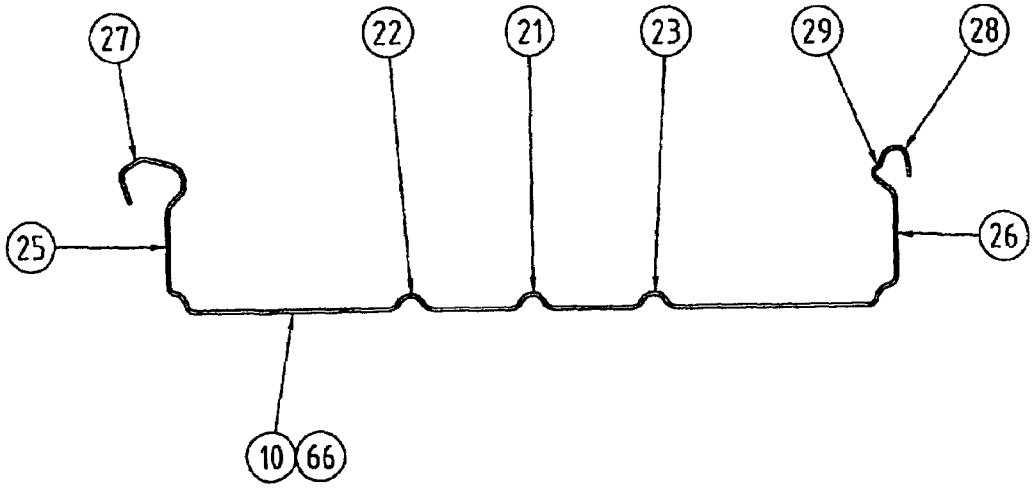
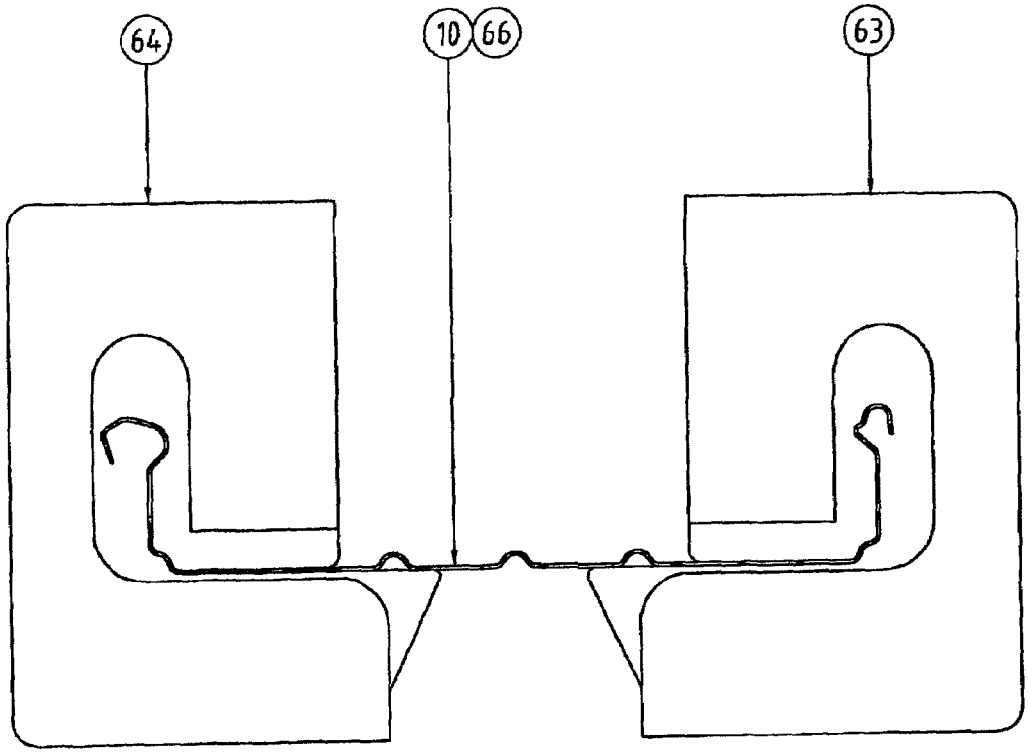
FIG 6

ROLL FORMING MACHINE

This application is a 371 of PCT/SE01/02601, filed Nov. 26, 2001.

FIELD OF INVENTION

The present invention relates to a machine which comprises forming/shaping rolls and which includes in a line means for unreeling sheet-metal strip from a reel of strip, strip cutters, and a roll-equipped sheet-forming section.

DESCRIPTION OF THE BACKGROUND ART

One method of covering roofs with thin metal roofing sheet includes the use of standing seams, i.e. seams that are of a height such as to always extend above any water that may be present on the roof. Seams are known which are snapped together without being squeezed, for instance the seams according to U.S. Pat. No. 5,519,974 and U.S. Pat. No. 5,535,567 wherein after having been placed together, the sheets are interlocked either with or without a sealing strip in respective seams, as illustrated in U.S. Pat. No. 6,115,899, for instance. The sheets are fastened to the roof in said seams, therewith avoiding through-penetrating nails or screws. Known machines for roll-forming the seam-forming edges can normally only shape the edges on sheeting of uniform width. Transverse seams are undesirable, and it is possible to produce long sheets in this way. Long roofing sheets are sometimes produced with a machine that is lifted onto the roof. This enables direct production of roofing sheets that are able to cover a very wide roof, said sheets being taken from a strip-carrying reel. Because production is carried out on the roof, it is possible to handle sheets that are several tens of meters in length.

JP 905 21 25 illustrates a machine that can roll-shape the edges of sheets that taper towards one end thereof. Such sheets are used, for instance, to cover the roofs of circular buildings. However, this machine can only handle piece-wise sheets that have been cut and edged in other equipment.

OBJECT OF THE INVENTION

An object of the present invention is to provide a machine that will enable roll-forming and/or roll-shaping of long sheets that need not necessarily have a constant uniform width, the sheets being directly cut from the strip. In principle, this object is achieved with a machine of the aforesaid kind in which the roll-forming section includes a line of forming stations that include forming rolls supported one-sided by shafts on respective sides of the sheet travelling path, wherein the forming stations in each row or line are motor-driven for movement transversely to the forming section, wherewith an edge cuter is allocated to each row of forming stations and connected to the first forming station such as to be movable together with said station. The invention is defined in the accompanying Claims.

BRIEF DESCRIPTION OF THE DRAWINGS

FIG. 3 illustrates an example of a sheet profile that can be obtained with the machine shown in FIGS. 1 and 2.

FIGS. 4, 5 and 6 are respectively fragmented sectional views of parts of the machine show in FIGS. 1 and 2, said views being taken respectively on lines 4—4, 5—5 and 6—6 in FIG. 1. FIG. 5 is also a sectional view taken on the line 5—5 in FIG. 11.

DESCRIPTION OF TWO ILLUSTRATED AND PREFERRED EMBODIMENTS

Figure 2:
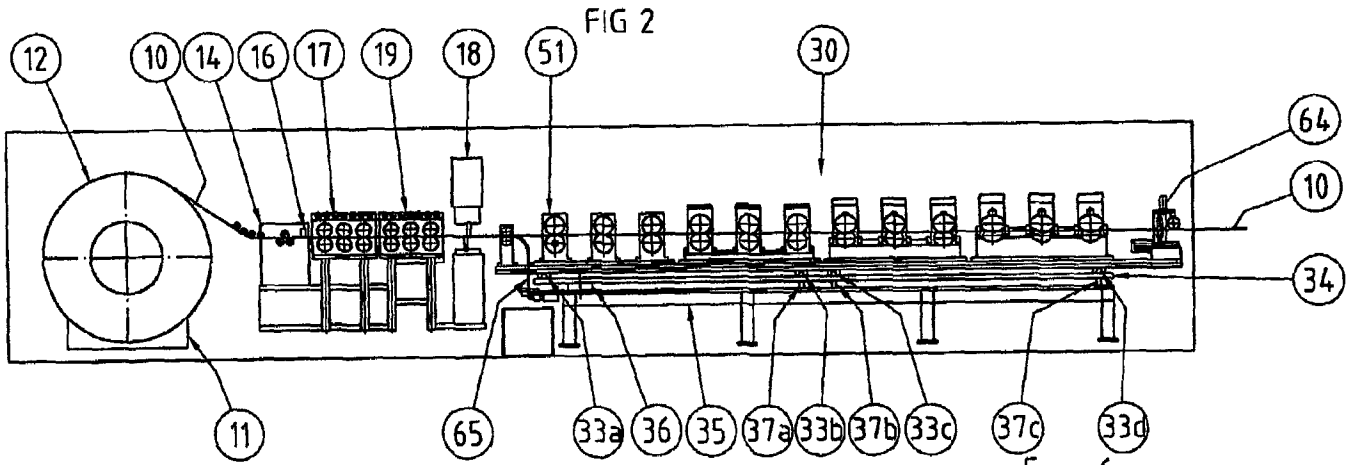
FIG. 2 is a side view of the same machine.
Figure 1:
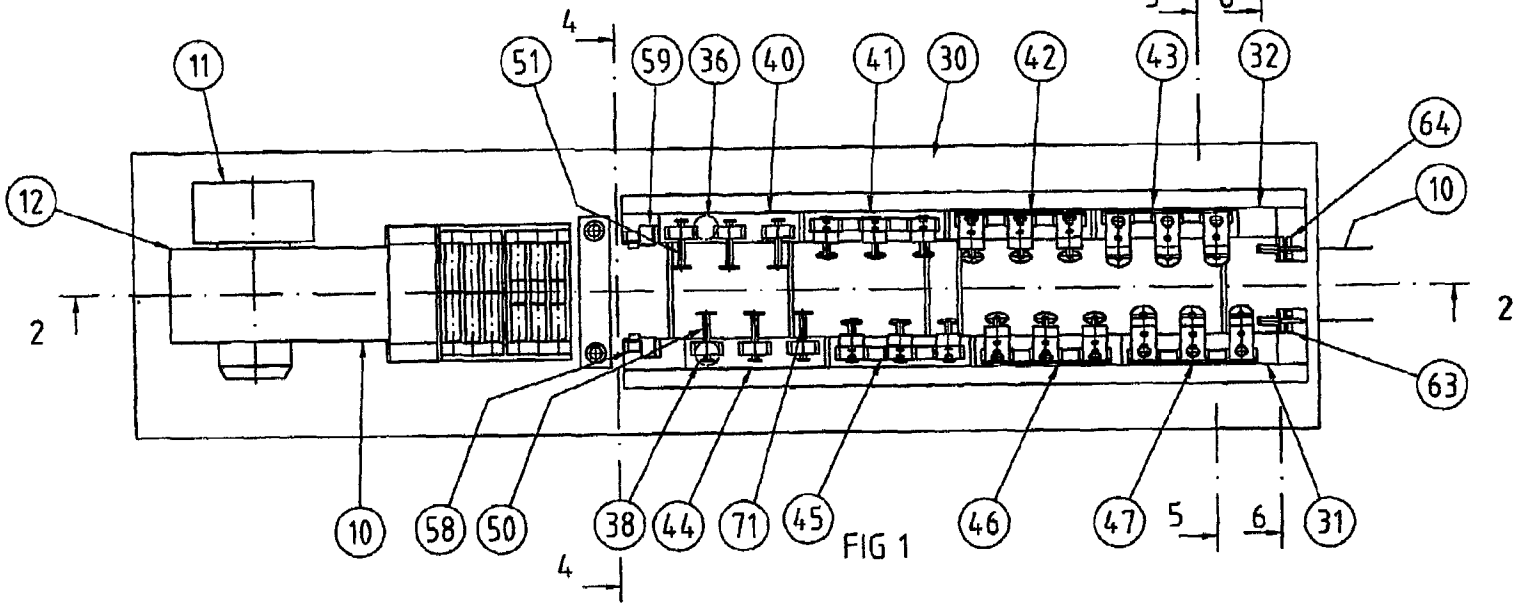
FIG. 1 is a top view of one example of a roll-equipped sheet forming machine according to the invention.

Shown in FIGS. 1 and 2 is a roll-forming machine that includes a device 11 for unwinding strip 10 from a metal strip reel 12, said strip being comprised, for instance, of steel, copper, zinc or aluminium Also included is a strip aligning device 14, which also functions to advance the strip, a sensor or detector 16 that measures the length of advanced strip, two short roll-forming parts 17, 19 and a cutter 18. The roll-forming sections 17 and 19 function to make two parallel grooves 21 and 22, 23 respectively in the sheet 10, as shown in FIG. 3. Either one, or both, of said sections 17, 19 can be made inoperative, by mutually separating rolls in said sections. FIG. 3 shows the finished sheet profile, which includes upstanding side-edges 25, 26 which are terminated with semi-circular dome-like structures 27, 28, said structures being dimensioned so that the smaller structure will fit into the larger structure. The smaller of these dome-like structures, i.e. the structure 28, has a seal-accommodating groove 29 and the structures are sealingly interlocked with the aid of a seaming machine, subsequent to covering a roof. The sheet are secured to the roof with clamps that extend up into the seams and therewith interlocked. These clamps are screwed to the roof, meaning that the sheets are completely devoid of screw holes.

The forward end of a forming section 30 for forming the side edges 25, 26 of the sheet and shaping said dome-like structures 27–29 is in immediate connection with the cutter 18. The section 30 includes two longitudinally extending forming-station carriers 31, 32 such as to form a sheet section between the carrier-supported forming stations. The carrier 32 is shown in FIG. 2. It will be seen that the carrier 32 is supported on four transverse guides 33*a*–*d* on an intermediate part 34, such as to enable the carrier to be displaced at right angles to its longitudinal axis and also to the longitudinal axis of the intermediate part. In turn, the intermediate part 34 is pivotally mounted to the fixed chassis 35 on a pivot attachment 36 and rests on three slide strips 37*a*–*c*. The intermediate part 34 and the carrier 32 can thus be swung as a unit about the pivot attachment 36, and the carrier 32 can be moved on the intermediate part 34 at right angles to its longitudinal axis. These movements are effected with the aid of motors and are controlled by a computer. In order not to complicate matters, the strip 10 is not shown in the forming section 30 in FIG. 1, although it is shown in FIG. 2.

The forming station carrier 31 is supported in the same way as the forming station carrier 32, and its pivot attachment 38 is indicated in FIG. 1.

Each of the forming station carriers 31, 32 carries four groups 40–43 and 44–47 respectively, with three pairs of forming stations each having forming rolls on free shafts, i.e. on shafts supported on one side. Each group has a motor for driving all three forming stations in the group. This drive is conventional and is therefore not shown. The figures show all roll shafts 71 in the absence of forming rolls; all that is shown on respective roll shafts is an end plate which functions to lock the forming rolls securely to their respective shafts.

Figure 4:
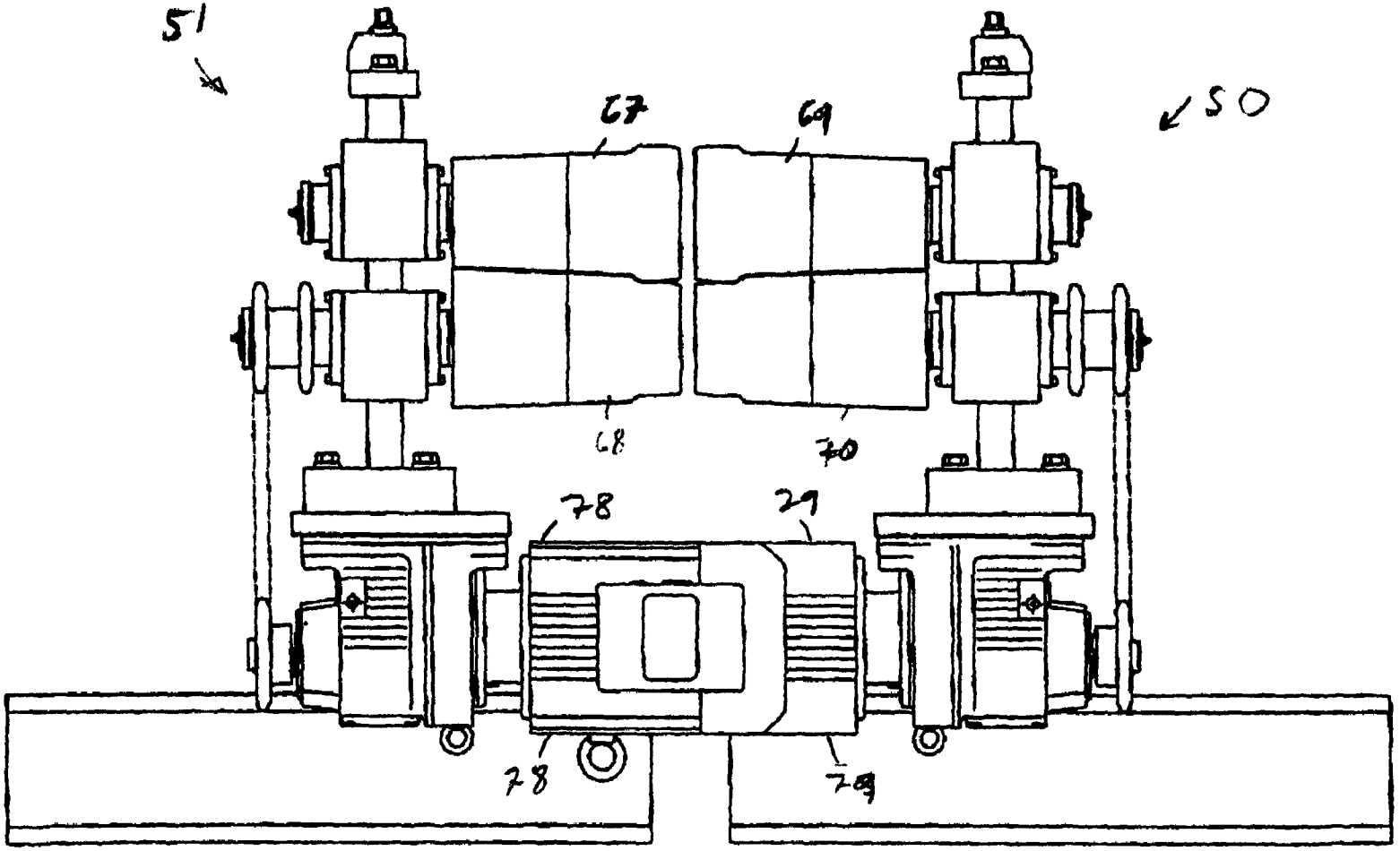
Figure 5:
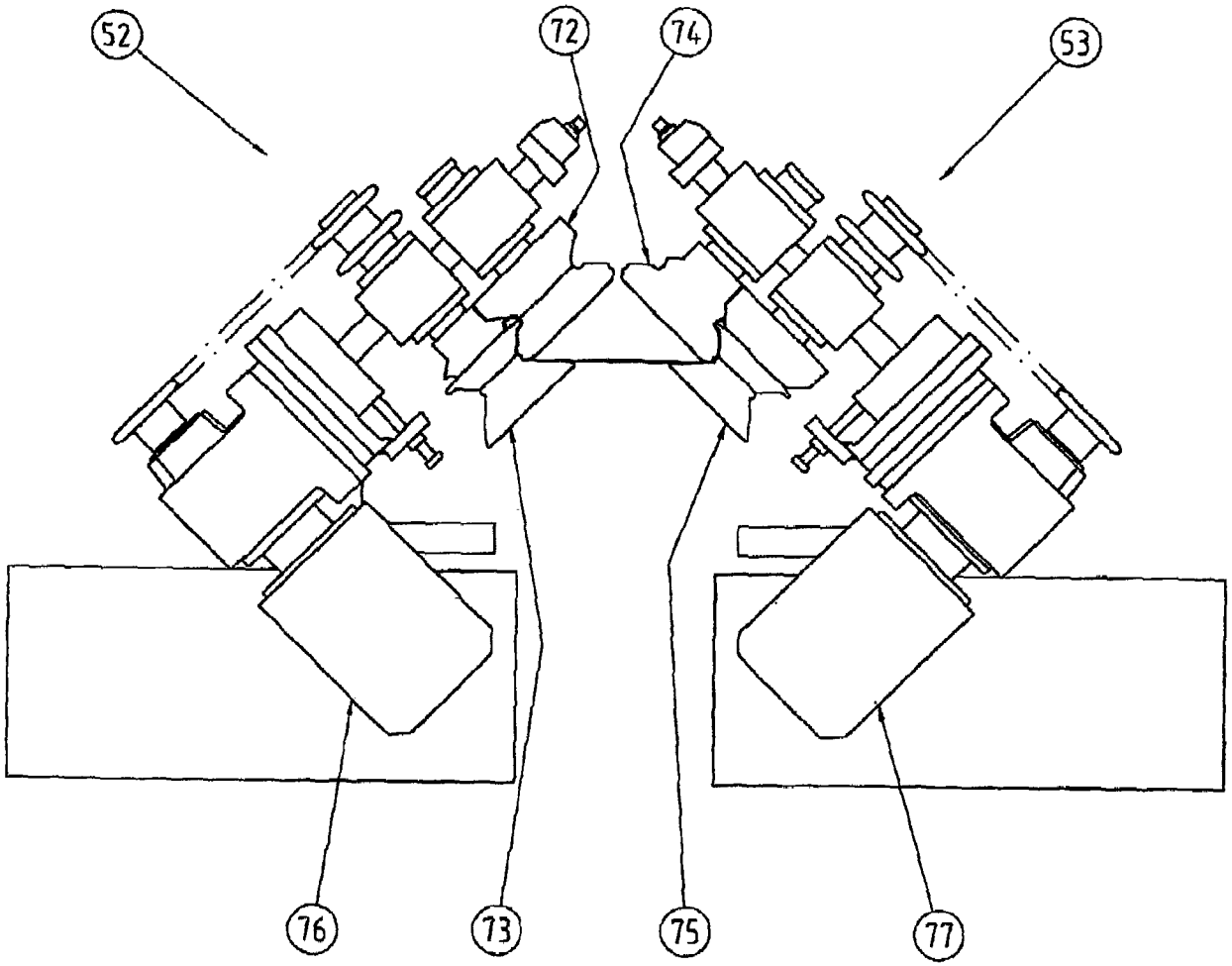

FIGS. 4 and 5 are fragmentary views of mutually opposing pairs of such forming stations. FIGS. 1 and 2 show all roll shafts 71 in the absence of forming rolls. The forming rolls 67–70 and 72–75 are shown fitted to respective shafts 71 solely in FIGS. 4 and 5. FIG. 4 shows the first pair of forming stations 50, 51 in the first groups 40, 44, and FIG. 5 shows the last pair of form stations 52, 53 in the last groups 41, 45. FIG. 5 is fragmentary and shows only the forming rolls and motor 76, 77 and belt drives that drive the rolls. FIG. 4 shows corresponding drive motors 78, 79 and belt drives.

The first group of forming stations 40, 44 situated on each side function to form grooves that extend parallel with the edges of the sheet. This group can be used as an alternative to or together with one of the units 17, 19 that form grooves which extend parallel with the symmetry line of the sheet. The remaining groups 41–43 and 45–47 are used to form the upstanding side edges 25, 26. Not all of the various pairs of forming stations are completely opposite one another, but are mutually offset in a zigzag fashion, so as not to interfere with each other when producing narrow sheet profiles. The fact that the forming stations have free roll shafts, i.e. that are supported only on one side, enables the roll shafts to be inclined. In turn, inclination of the roll shaft enables the forming rolls to have a relatively small diameter and a simple form, therewith enabling the roll pairs to be close together and in a mutually offset pattern, so that the entire roll forming section will be short.

Mounted on the carriers 31, 32, upstream of the first forming station pair 50, 51, is a pair of edge cutters 58, 59 which accompany movement of the first pair of forming stations 50, 51 both with respect to angular settings and also with respect to parallel movement towards and away from each other, i.e. parallel movement towards and away from the centre line of the forming section and therewith also the centre line of the sheet path. The edge cutters may be comprised of circular shears. FIG. 2 shows a severed edge 65.

Downstream of the last pair of forming stations 61, 62 is a pair of profile cutters 63, 64 which are mounted on the carriers 31, 32 so as to follow the angular setting and parallel movement of the last pair of forming stations, so as to accompany the first pair of forming stations 50, 51, in a way similar to the edge cutters 58, 59. The upstanding side edges 25, 26 of a finished profile can be cut in the profile cutters 63, 64, as shown in FIG 6.

The cutter 18 is a parallel cutter with convex cutting blades such that the blade-overlap increases from the centre. Thus, the cutting length can be varied and there can be made in the strip or sheeting a cut that terminates short of the edges, by appropriate adjustment to the length of cutting stroke. Alternatively, the strip can be severed completely.

FIG. 1 shows the forming section 30 when set for profiling metal sheet of constant profile width. It may then be advantageous to profile continuous strips and cut the strip into sheet form after profiling the strip. This gives greater measurement accuracy with respect to the end of the sheet. In this regard, the cutter 18 is caused to make a cut that terminates short of the edges of the strip, whereafter the edges are cut to a finished profile by the profiling cutters 63, 64, as shown in FIG. 6. The commencement and termination of the cutting operations are controlled by a computer to which the length measuring sensor 16 is connected. The edge cutters 58, 59 need not be used, when the strip 10 has the correct width and also fine edges,. However, a slightly wider strip can be used and narrow strips cut from the edge of the strip, so as to ensure that a fine edge is obtained. A severed edge 65 is shown in FIG. 2.

Figure 7:
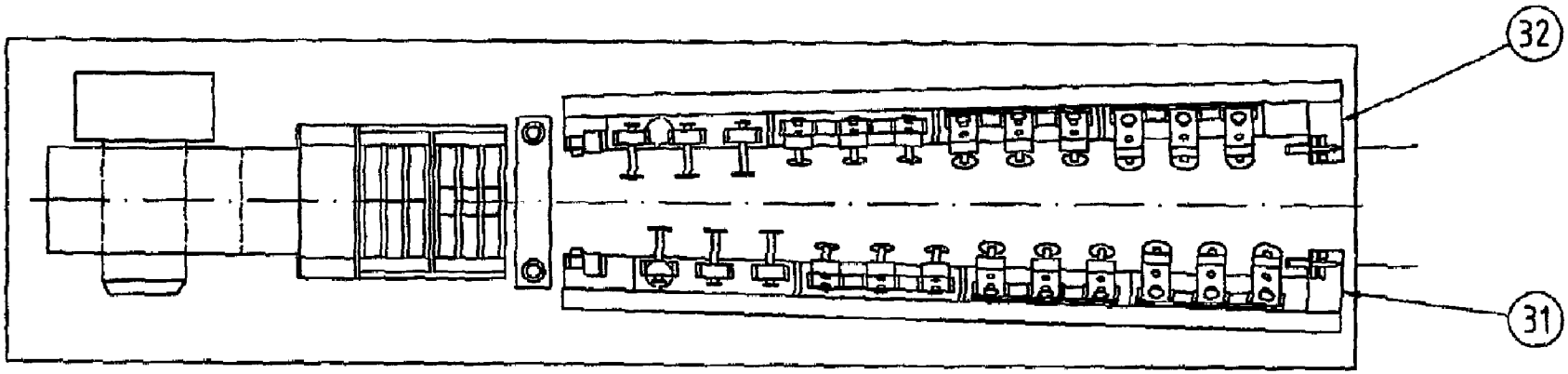
FIG. 7 corresponds to part of the FIG. 1 illustration, although some features are shown in different positions.

FIG. 7 shows the forming section adapted to shape the so-called conical sheet i.e. sheets that narrow towards one end. The rear end of the carriers 31, 32 are swung-out symmetrically from one another, by having swung the intermediate parts 34 in their respective pivot attachments and locking said parts in their angular settings.

Figure 8:
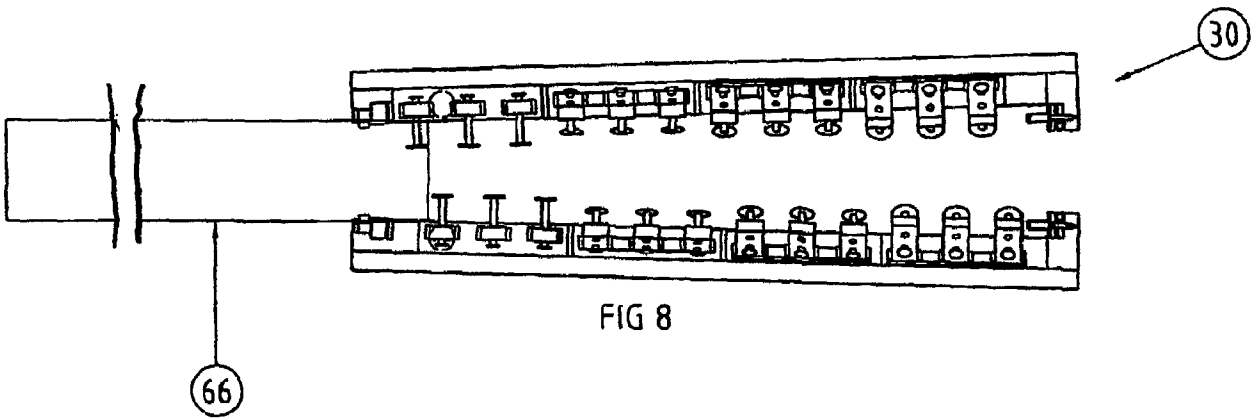
FIGS. 8–10 correspond to FIG. 7 and illustrate different phases in a sheet roll-forming operation.
Figure 9:
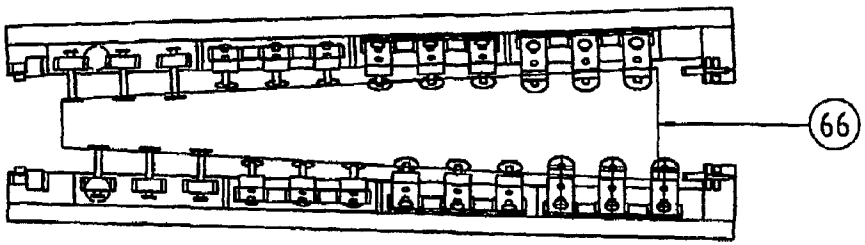
Figure 10:
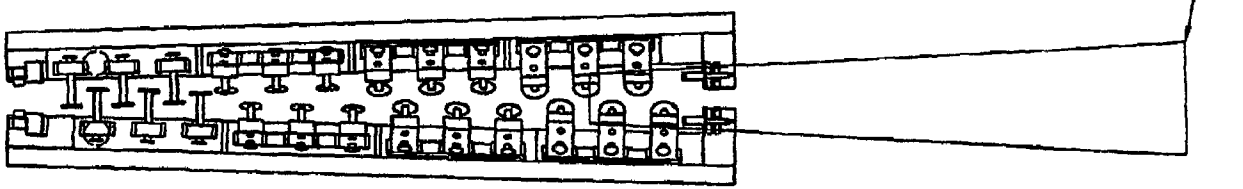

Roll-forming of a sheet is commenced with each intermediate part 34 swung in its pivot attachments 36, 38 and sliding on their respective slide strips 37*a*–*c*, such that the forming stations will be adapted to first shape the widest end of an individual sheet This angular setting is locked. The sheet 10 is fully severed in the cutter 18 to obtain a separate sheet 66 that is fed into the forming section, as shown in FIG. 8. As the sheet 66 is fed into the forming section 30 by the strip aligning device 14, the carriers 31, 32 are moved in parallel symmetrically in towards the centre line of the forming section, with the aid of ball-screws (not shown), so that the edge cuts 58, 59 will cut away continuously increasing edge strips and therewith continuously reduce the width of the sheet. FIG. 9 shows the sheet 66 when it is midway in the forming section, and FIG. 10 shows the sheet 66 upon its exit from said section. The speed at which the sheet 66 is advanced and the speed at which parallel movement of the carrier 31, 32 takes place must be adapted so that each forming roll of the various forming stations will work in the correct groove on the narrowing strip. This process is controlled by a computer connected to the sensor 16 and to sensors (not shown) that detect width positions of the carriers 31, 32.

When the sensor 16 delivers a signal indicating that the strip shall be cut, the computer stops all advancement of the strip and the strip is cut in the cutter 18. The feed and forming of the severed sheet is then resumed until forming of the sheet has been completed, whereafter the formed/shaped sheet is discharged from the forming unit 30.

When forming of a sheet that has been cut from the strip is finalised, the measurement accuracy of the end of the sheet is worse than when a sheet is cut from a ready shaped strip. When desiring to improve the measurement accuracy with respect to said end, a cut which terminates short of the edges can be made with the cutter 18 and the strip then advanced through a distance of, e.g., 1–2 dm, after which the strip is severed completely. The strip is then advanced through a further 1–2 dm and a further cut that terminates short of the edge is made. The profile cutters 63, 64 can then be used to sever the sheet completely in line with the two aforesaid cuts, and therewith improve end accuracy. This results in improved accuracy with respect to both ends, at the cost of a piece of scrap of less than 0.5 meter between two sheets and also at the cost of a slightly lower production rate due to stoppages.

In order to produce sheet that has a pronounced taper and that is very narrow at one end, it may be necessary to divide the carriers so that rear carrier parts with the last two groups 42, 43, 46, 47 of forming stations on each side can continue to be moved in towards each other when the sheet has left the first two groups 40, 41, 44, 45 of forming stations and the front parts of the carriers cannot be moved closer together.

FIGS. 7–10 illustrate roll-forming of sheet that tapers towards one end, wherewith the widest part of the sheet is roll-shaped first. However, it is, of course, possible to roll-shape the narrowest end first. This may be an advantage when the machine is placed on the roof to be covered, close to the base of the roof, and when roll-forming roof plates that are several tens of meters in length and roll-forming the sheet upwardly towards the centre of the roof, since the plate will then have the correct end upwards.

The length of the illustrated machine may be sufficiently short to enable the machine to be embodied in a freight container of standard size, i.e. 12 m×2.4 m, and the container lifted together with the machine by a crane onto the roof to be covered with roof sheeting. A diesel-driven electrical power plant may be built into the container, so that the machine will be self-sustaining. The invention is not restricted to machines for profiling roof sheeting with standing seams, but can also be used for other kinds of roll-forming.

Figure 12:
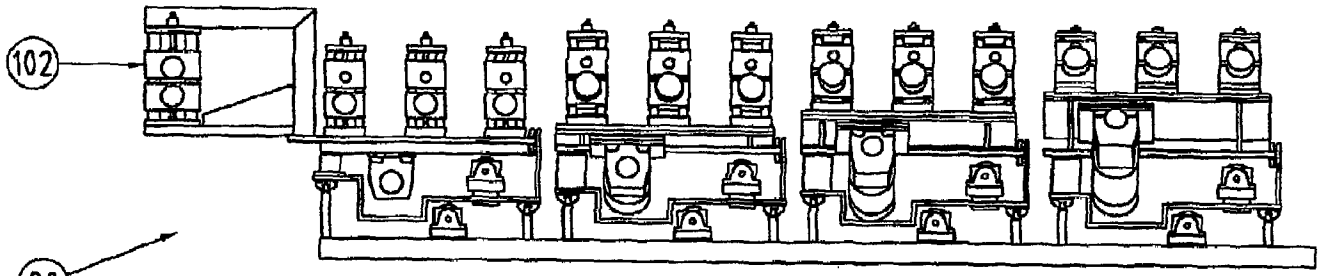
FIG. 12 is a side view of the roll-forming section shown in FIG. 8.
Figure 11:
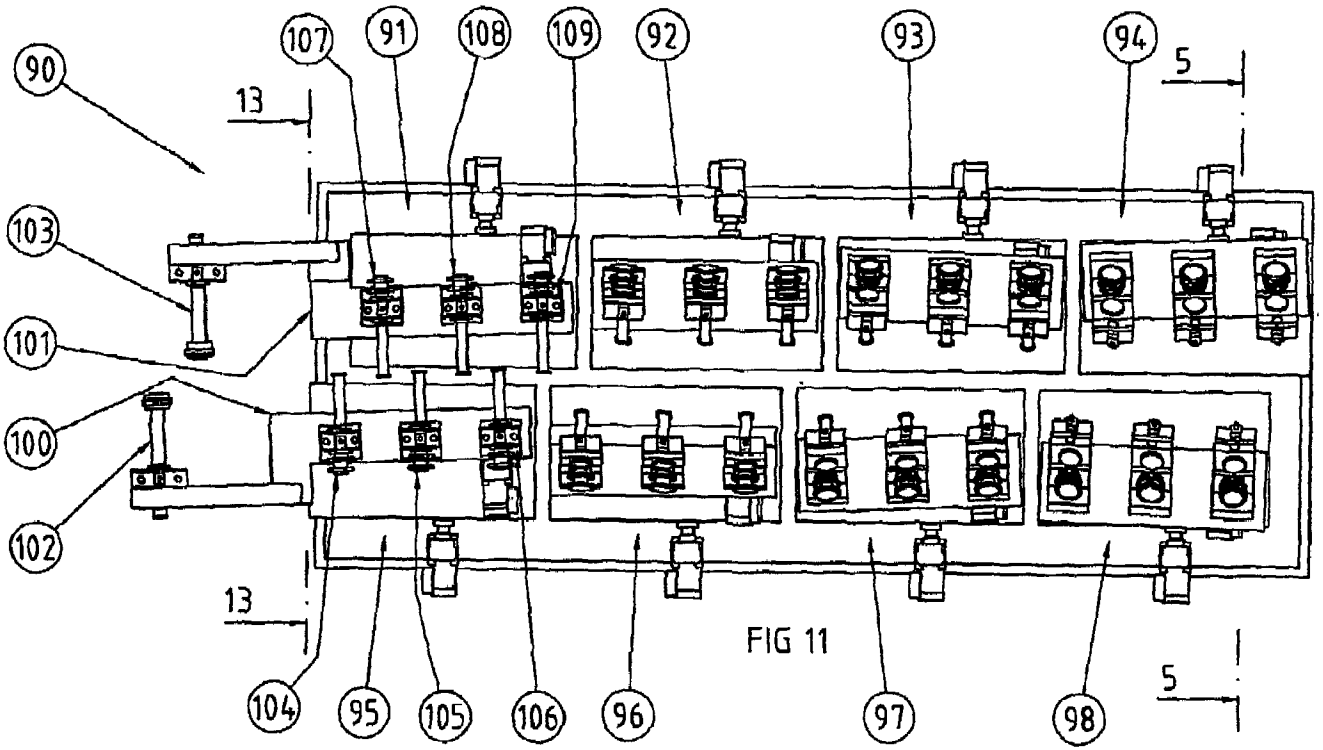
FIG. 11 is a top view of a roll-forming section that is, according to the invention, an alternative to the roll-forming section shown in FIGS. 1 and 2.
Figure 15:
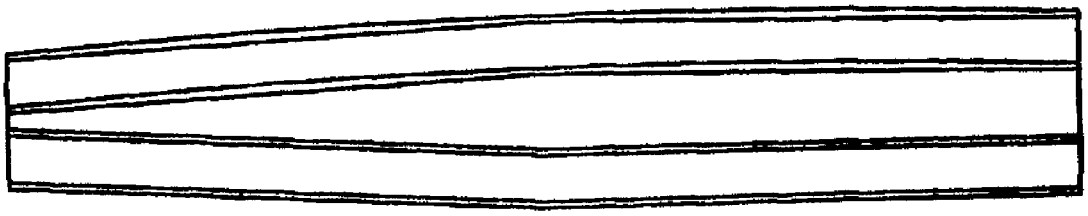
FIGS. 15 and 16 illustrate examples of roofing sheet that can be produced with a machine that includes the roll-forming section shown in FIGS. 11–14.
Figure 16:
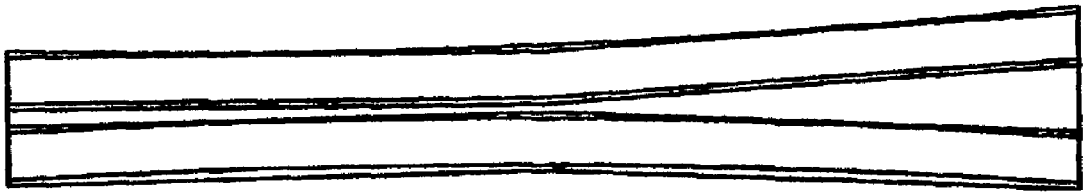
Figures 1, 2:
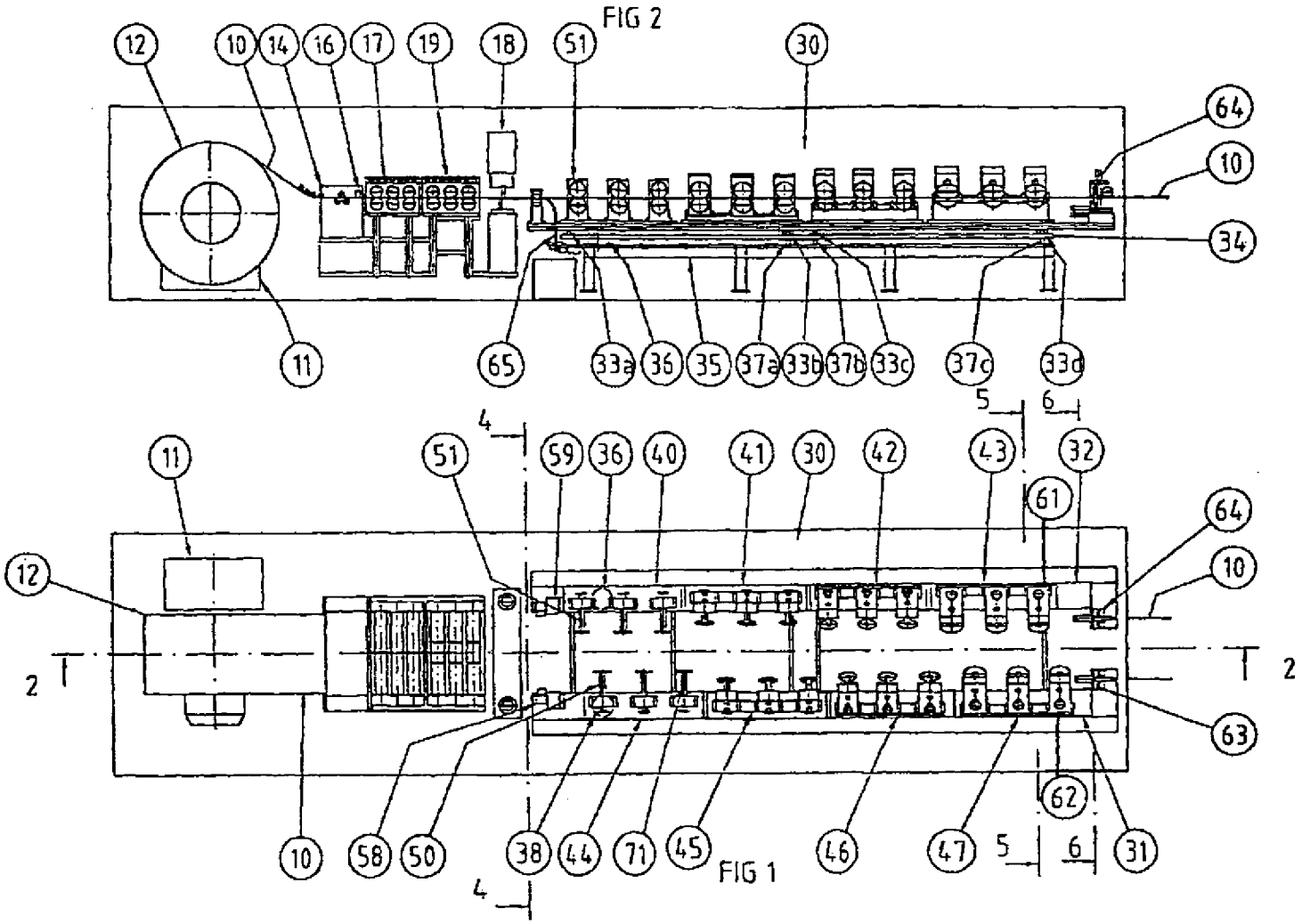
Figure 15:
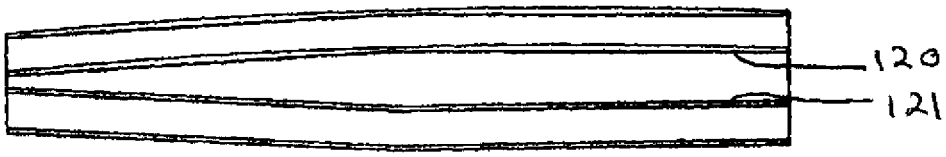
Figure 16:
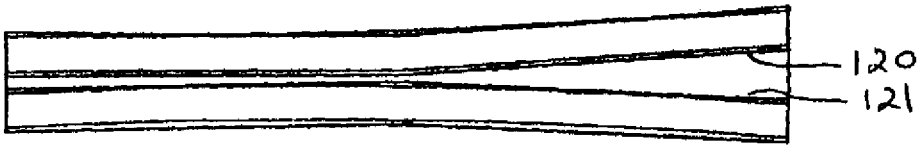

FIGS. 11 and 12 illustrate a roll-forming section 90 which is modified version of the roll-forming section 30 of the proceeding figures. The forming section 90 includes four groups 91–94 and 95–98 respectively of forming stations on each side of the sheet section, similar to the earlier described embodiment. In this embodiment, each group has a carrier which is movable in parallel and the angulation of which can be adjusted individually. The carriers 100,101 (corresponding to the carriers 31, 32 in FIGS. 1–2) in the first groups 91, 95 each carry a respective edge cutter 102, 103, in addition to carrying three forming stations 104–109. Because each group 91–98 can be adjusted individually, it is not only possible to work towards one end of tapering sheets, but also to produce sheets that include selective curve shapes within given limits, therewith providing the architects with a high degree of freedom in, for instance, drawing dome-like roof structures that have either a constant or a varying radius of curvature. FIGS. 15 and 16 illustrate examples of roof sheets for dome-like roofs that can be produced in the roll-forming part 90. The roof plates include grooves 120, 121 which extend parallel with the edges of said sheets, i.e. grooves made in the first groups 91, 95 of forming stations in the forming section 90. The edge cutters 102, 103 always move in unison with the first pair of forming stations, and this forming section can also be coupled directly to a device for unreeling strip, as in the earlier described embodiment.

Figure 13:
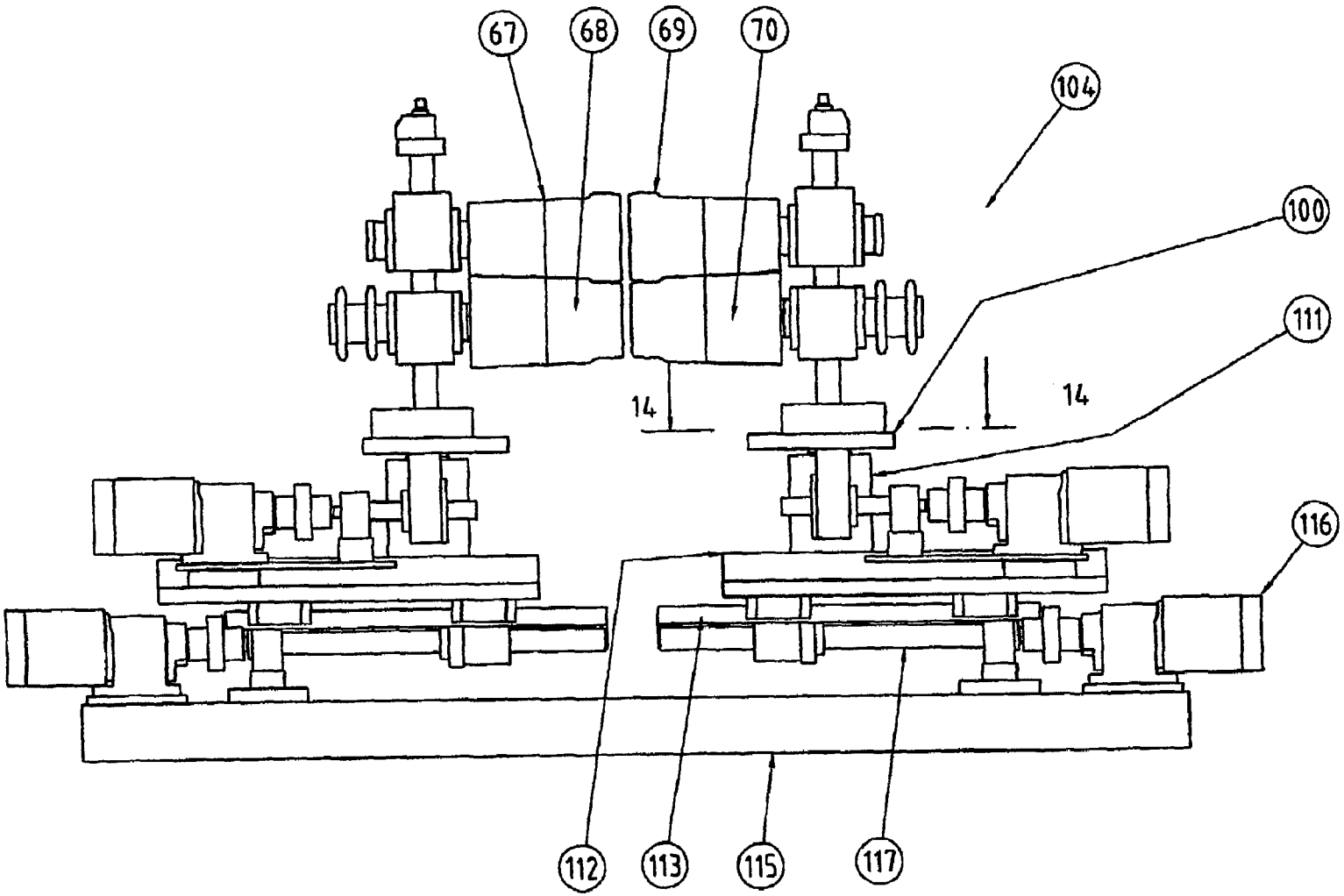
FIG. 13 is a cross-sectional view taken on the line 13—13 in FIG. 11.
Figure 14:
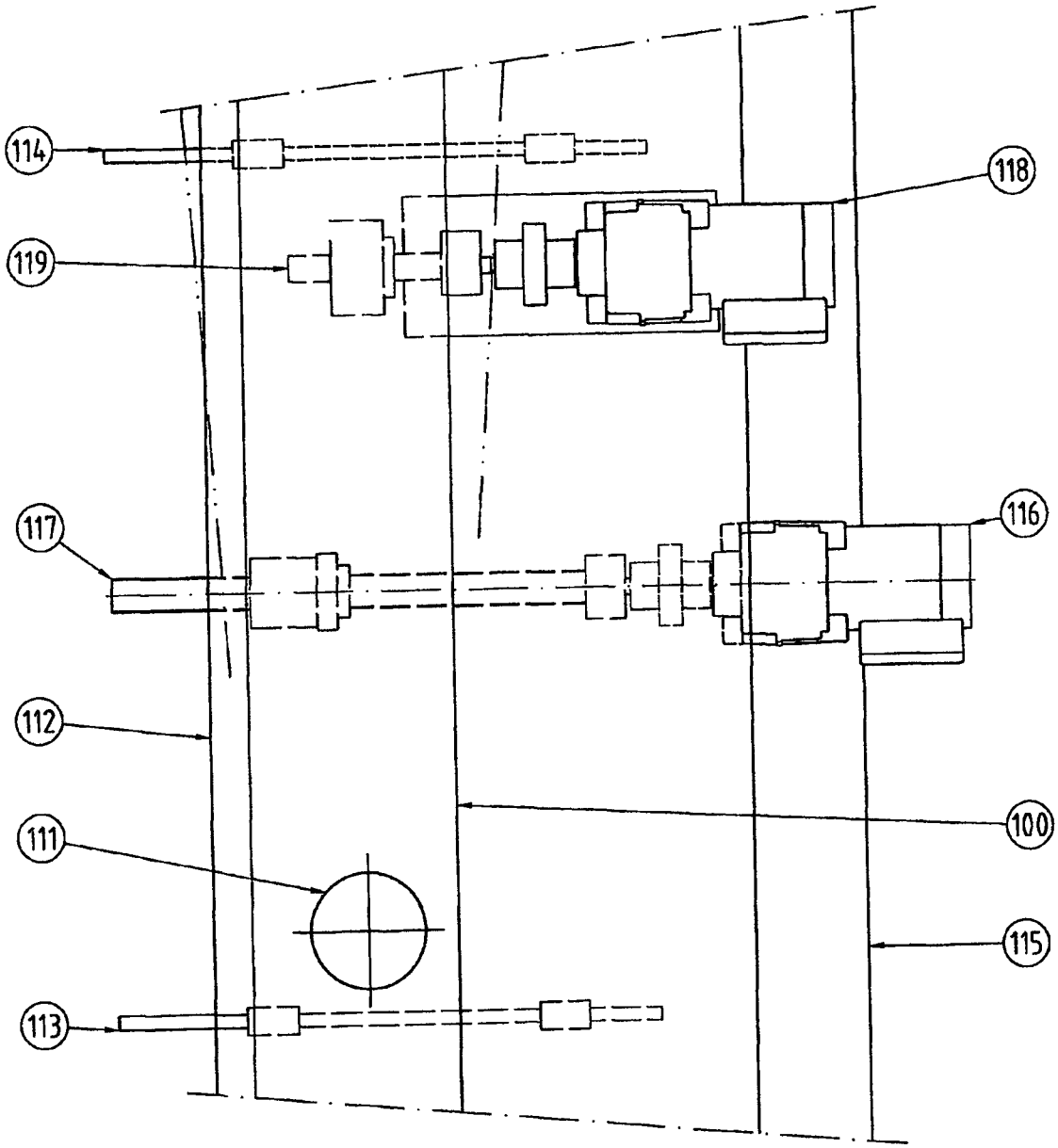
FIG. 14 is a sectional view taken on the line 14—14 in FIG. 13.

FIG. 13 illustrates the first pair of forming stations 104, 107 in the fist group 91, 95. The forming rolls have been identified by the same reference signs 67–70 as those used in FIG. 4, since these rolls are similar to those illustrated in said figure. Because of the existing symmetry, only the forming station 104 is described. The forming rolls 69, 70 are carried by the carrier 100, which is attached to a pivot attachment 111 (FIG. 14) on an intermediate part 112. The intermediate part 112 is carried displaceably by slide bars 113, 114 on the fixed chassis (stand) 115, and can be moved by means of a motor 116 and a ball-screw 117. The carrier 100 can be pivoted on the intermediate part 112, by means of a motor 118 and a ball-screw 119. FIG. 14 shows two alternative angular positions of the carrier 100 in chain lines.

Thus, the angle of the carrier 100 can be adjusted in relation to the longitudinal axis of the forming section, and the carrier can also be moved in parallel transversely to said longitudinal axis, such as to enable simultaneous movement and angular adjustment of the forming stations carried thereby. Each group of forming stations is movable individually in this way, meaning that it is also possible to produce sheets having curved edges and varying radius of curvature on each individual sheet, in addition to producing sheets with straight edges. Because each group includes more than one forming station and because said stations are commonly supported by one carrier, it is only possible for one of the forming stations in each group to follow precisely the correct groove, although in the case of reasonable curve radii the error will only be in the order of magnitude of one millimeter. Such an error will not disturb the function. In the case of small radii of curvature, it is necessary for each forming station to be adjustable individually. However, it is possible in practice to adjust the settings of two or more forming stations in common, as shown.

The invention claimed is:

1. A roll forming machine including, in line, a device for unwinding metal strip from a strip-carrying reel, a cutter for cutting the strip, and a forming section defining a sheet path, characterised in that the forming section includes a plurality of forming rolls; said forming rolls being arranged in first and second opposed rows along opposed sides of the sheet path; a plurality of forming stations defined by said plurality of forming rolls, each of said forming stations being defined by a pair of said forming rolls; each of said forming rolls being mounted on a one-sided support shaft; wherein the forming rolls on both of said opposed rows are movable across the forming section by motorized drive means, and an edge cutter is allocated to each of said opposed rows and is coupled for movement together with the first of said forming stations defined by a first pair of said plurality of forming rolls; and first and second cutters having profiled cutting edges are allocated to said first and second opposed rows, respectively, and are disposed downstream of the last of said forming stations defined by said plurality of forming rolls on said first and second opposed rows.

2. A roll forming machine including, in line, a device for unwinding metal strip from a strip-carrying reel, a cutter for cutting the strip, and a forming section defining a sheet path, characterised in that the forming section includes a plurality of forming rolls; said forming rolls being arranged in first and second opposed rows along opposed sides of the sheet path; a plurality of forming stations defined by said plurality of forming rolls, each of said forming stations being defined by a pair of said forming rolls; each of said forming rolls being mounted on a one-sided support shaft; wherein the forming rolls on both of said opposed rows are movable across the forming section by motorized drive means, and an edge cutter is allocated to each of said opposed rows and is coupled for movement together with a first forming station defined by a first pair of said forming rolls; wherein one said forming roll of a first said forming station in said first opposed row and said edge cutter allocated to said first opposed row are mounted on a first common, movable carrier, for movement in unison with each other; and one said forming roll of said first forming station in said second opposed row and said edge cutter allocated to said second opposed row are mounted on a second common, movable carrier, for movement in unison with each other wherein, first and second cutters having profiled cutting edges are allocated to said first and second opposed rows, respectively, and are disposed downstream of the last of said forming stations defined by said plurality of forming rolls on said first and second opposed rows.

3. A roll forming machine, including, in line, a device for unwinding metal strip from a strip-carrying reel, a cutter for cutting the strip, and a forming section defining a sheet path, characterized in that the forming section includes a plurality of pairs of carriers, said carriers of each said pair being disposed on opposite sides of a longitudinal axis extending between said pairs of carriers, each said carrier having at least two forming rolls carried thereon so as to define at least one forming station between a pair of said forming rolls on each of said opposed carriers, means for individually moving said opposed carriers of each said pair of carriers in a direction substantially transverse to said longitudinal axis, means for individually adjusting the angular orientation of each of said opposed carriers of each said pair of carriers relative to said longitudinal axis, a first motor for driving said at least two forming rolls of said at least one forming station on one said carrier of one said pair of carriers, and a second motor for driving said at least two forming rolls of said at least one forming station on said opposed carrier of said one pair of carriers, and a pair of edge cutters disposed on opposite sides of said longitudinal axis upstream of the first said pair of opposed forming stations.

4. The roll forming machine as claimed in claim 3, wherein said means for individually moving said opposed carriers in a direction substantially transverse to said longitudinal axis comprises computer control means.

5. The roll forming machine as claimed claim 3, wherein said means for individually adjusting the angular orientation of each of the opposed carriers of each said pair of carriers relative to said longitudinal axis comprises computer control means.

6. The roll forming machine as claimed in claim 3, further comprising computer control means for controlling the rotational speed of said first and second motors.

7. The roll forming machine as claimed in claim 3, wherein said pair of edge cutters is carried on said first pair of opposed carriers.

8. The roll forming machine as claimed in claim 3, wherein said pair of edge cutters is disposed on supporting elements forward of said first pair of opposed carriers.

9. The roll forming machine as claimed in claim 3, wherein at least some of said forming rolls of said opposed pairs of carriers are laterally offset from each other.

10. A roll forming machine, including, in line, a device for unwinding metal strip from a strip carrying reel, a cutter for cutting the strip, and a forming station defining a sheet path, characterized in that the forming section comprises a first single carrier having a plurality of forming rolls thereon, and a second single carrier having a plurality of forming rolls thereon, said first and second single carriers disposed on opposed sides of a longitudinal axis, said plurality of forming rolls on said first single carrier defining thereon a plurality of forming stations between pairs of said forming rolls, and said plurality of forming rolls on said second single carrier defining thereon a plurality of forming stations between pairs of said forming rolls, said forming rolls on said first single carrier being fixedly mounted to said first single carrier, and said forming rolls on said second single carrier being fixedly mounted to said second single carrier, means for moving said first and second carriers substantially transverse to said longitudinal axis, means for adjusting the angular orientation of said first and second carriers relative to said longitudinal axis, and a pair of edge cutters disposed on said first and second carriers on opposed sides of said longitudinal axis upstream from the first said forming station.

11. The roll forming machine as claimed in claim 10, wherein said means for moving said first and second carriers substantially transversely to said longitudinal axis comprises computer control means.

12. The roll forming machine as claimed in claim 10, wherein said means for adjusting the angular orientation of said first and second carriers relative to said longitudinal axis comprises computer control means.

13. The roll forming machine as claimed in claim 10, wherein at least some of said forming rolls on said first and second carriers are laterally offset from each other.

14. A roll forming machine, including, in line, a device for unwinding metal strip from a strip carrying reel, a cutter for cutting the strip, and a forming station defining a sheet path, characterized in that the forming section comprises a first single carrier having a plurality of forming rolls thereon, and a second single carrier having a plurality of forming rolls thereon, said first and second single carriers disposed on opposed sides of a longitudinal axis, said plurality of forming rolls on said first single carrier defining thereon a plurality of forming stations between pairs of said forming rolls, and said plurality of forming rolls on said second single carrier defining thereon a plurality of forming stations between pairs of said forming rolls, said forming rolls on said first single carrier being fixedly mounted to said first single carrier, and said forming rolls on said second single carrier being fixedly mounted to said second single carrier, means for moving said first and second carriers substantially transverse to said longitudinal axis, means for adjusting the annular orientation of said first and second carriers relative to said longitudinal axis, and a pair of edge cutters disposed on opposed sides of said longitudinal axis upstream from the first said forming station, said roll forming machine further including a first motor for driving at least two of said plurality of forming rolls on said first single carrier, and a second motor for driving at least two of said plurality of forming rolls on said second single carrier.

15. The roll forming machine as claimed in claim 14, wherein said pair of edge cutters is disposed on said first and second carriers.

16. The roll forming machine as claimed in claim 14, wherein said means for moving said first and second carriers substantially transversely to said longitudinal axis comprises computer control means.

17. The roll forming machine as claimed in claim 14, wherein said means for adjusting the angular orientation of said first and second carriers relative to said longitudinal axis comprises computer control means.

18. The roll forming machine as claimed in claim 14, wherein at least some of said forming rolls on said first and second carriers are laterally offset from each other.

* * * * *

UNITED STATES PATENT AND TRADEMARK OFFICE

CERTIFICATE OF CORRECTION

PATENT NO. : 7,107,807 B2
APPLICATION NO. : 10/432473
DATED : September 19, 2006
INVENTOR(S) : Lars Ingvarsson et al.

It is certified that error appears in the above-identified patent and that said Letters Patent is hereby corrected as shown below:

Delete Drawing Sheets 1 and 10 and Substitute therefor the Drawing Sheets Consisting of FIGS 1 – 2 and 15 – 16 Shown on the Attached Page Signed and Sealed this Twenty-first Day of April, 2009

John Doll

JOHN DOLL
*Acting Director of the United States Patent and Trademark Office*

64
10
34
33d
37c
33c
37b
33b
37a
35
36
33a
65
30
51
18
19
17
16
14
10
12
11
32
61
43
42
41
40
36
59
51
63
31
62
47
46
45
71
44
38
50
58
10
11
12
2
4
5
6